US007204293B2

(12) United States Patent
Newcomb

(10) Patent No.: US 7,204,293 B2
(45) Date of Patent: Apr. 17, 2007

(54) LINER SEAT DESIGN FOR A FOUNDRY MOLD WITH INTEGRATED BORE LINER AND BARREL CORE FEATURES

(75) Inventor: Thomas P. Newcomb, Defiance, OH (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/250,216

(22) Filed: Oct. 14, 2005

(65) Prior Publication Data

US 2006/0042770 A1 Mar. 2, 2006

Related U.S. Application Data

(63) Continuation-in-part of application No. 10/783,405, filed on Feb. 20, 2004, now Pat. No. 7,104,307.

(51) Int. Cl.
*B22C 15/24* (2006.01)

(52) U.S. Cl. ..... 164/21; 164/200

(58) Field of Classification Search ..... 164/132, 164/369, 112, 332, 19, 20, 21, 22, 200, 201, 164/202

See application file for complete search history.

(56) References Cited

U.S. PATENT DOCUMENTS 3,769,880 A * 11/1973 Mirjanic ..... 92/169.1
4,446,906 A 5/1984 Ackerman et al.
5,232,041 A 8/1993 Kuhn
5,320,158 A * 6/1994 Helgesen ..... 164/76.1
5,361,823 A 11/1994 Kuhn et al.
5,365,997 A 11/1994 Helgesen et al.
5,607,006 A 3/1997 Koch
5,771,955 A 6/1998 Helgesen et al.
5,983,975 A 11/1999 Nilsson
6,363,995 B1 4/2002 Baranzke
6,527,040 B2 * 3/2003 Singer et al. ..... 164/137
6,533,020 B2 * 3/2003 Shade ..... 164/137
6,615,901 B2 * 9/2003 Kaminski et al. ..... 164/137
6,865,807 B2 3/2005 Miyamoto et al.
7,104,307 B2 * 9/2006 Newcomb et al. ..... 164/112

* cited by examiner

*Primary Examiner*—Kevin P. Kerns
(74) *Attorney, Agent, or Firm*—Charles H. Ellerbrock

(57) ABSTRACT

A method is disclosed for producing a casting mold for an engine block, the casting mold includes a mold seat for a cast-in-place cylinder bore liner, the seat having a surface disposed at an angle relative to a longitudinal axis of the cylinder bore liner, wherein the cylinder bore liner becomes slightly unseated upon thermal expansion.

15 Claims, 9 Drawing Sheets

LINER SEAT DESIGN FOR A FOUNDRY MOLD WITH INTEGRATED BORE LINER AND BARREL CORE FEATURES

CROSS-REFERENCE TO RELATED APPLICATION

This application is a continuation-in-part application of and claims the benefit of U.S. patent application Ser. No. 10/783,405 filed on Feb. 20, 2004, now U.S. Pat. No. 7,104,307, hereby incorporated herein by reference.

FIELD OF THE INVENTION

The present invention relates to molds used to produce castings that require cylindrical objects to be embedded in the casting, and more particularly to casting molds for engine blocks with cast-in-place cylinder bore liners.

BACKGROUND OF THE INVENTION

The inner walls of the cylinder bores of internal combustion engines are required to withstand an abrasive action of a piston and seal rings disposed thereon. In models with cast iron engine blocks, the cast iron provides the required resistance. In other models, including some V-engine blocks in which aluminum or other lightweight material is used, a cylinder bore liner is disposed in a cylinder bore to provide adequate wear resistance.

In many engine block casting processes, cylinder bore liners are an integral part of the process. The cylinder bore liners are assembled into a mold prior to the introduction of molten metal into a mold cavity to form the engine block. Placement of the cylinder bore liner onto the barrel core may be accomplished by placing the cylinder bore liner onto a barrel core feature. This is known as the assembled liner method. Alternatively, the cylinder bore liner can be combined with the barrel core by placing the cylinder bore liner into a barrel core tool and forming the barrel core feature inside the liner. This is known as a blown-in liner method.

After casting, when the mold is removed, the cast-in-place cylinder bore liners are permanently embedded within the cast metal walls of the cylinder bores. The cylinder bore liners are often preheated prior to filling the mold with aluminum to improve mechanical contact between the cylinder bore liners and the walls of the cylinder bores and avoid imperfections that are caused by thermal variations between the cylinder bore liners and the molten metal. Any conventional heating method can be used to preheat the cylinder bore liners such as induction heaters, for example.

In a sand casting process, often referred to as a precision sand casting process, an expendable mold package 40 is assembled as shown in FIG. 1. The mold package 40 is assembled from various mold segments and mold cores including a valley core 42, a crankcase core 43, a barrel slab core 44, and a water jacket core 45. The mold cores are combined to define internal and external surfaces of the engine block. The mold segments and mold cores are made of resin-bonded sand. Proper positioning of cylinder bore liners 46 in the mold and prevention of migration of the cylinder bore liners 46 during preheating and casting presents an ongoing challenge.

Some attempts to address the positioning and migration issue require that chamfered cylinder bore liners remain seated on corresponding chamfered seating surfaces of the mold cores 43 and/or 44 during thermal expansion. The prior art provides for chamfered surfaces that are inclined with respect to a plane perpendicular to an axis of the cylinder bore liners at specific angles to ensure that the cylinder bore liners remain seated and in contact with seat surfaces of the mold package 40 during pre-heating and casting. These angles are calculated using nominal (theoretical) dimensions for the length and radius of the cylinder bore liners and assume uniform in-situ thermal expansion of the liners during preheating and casting.

In practice, the theoretical conditions are typically not met and the variation can cause the expanding cylinder liners to exert forces against the constraining mold seats. As a result, the mold seats are either caused to move relative to one another, or the seat is fractured, contaminating the mold with resin bonded sand. These consequences are undesirable and potentially more catastrophic than a small amount of cylinder bore liner migration.

It is desirable to provide an improved method of producing a casting mold with cast-in-place cylinder bore liners.

SUMMARY OF THE INVENTION

Consistent and consonant with the present invention, an improved method of producing a casting mold with cast-in-place cylinder bore liners has surprisingly been discovered.

In one embodiment, the method of producing a casting mold for an engine block comprises the steps of providing a cast-in-place cylinder bore liner having a longitudinal axis, the bore liner having a chamfer formed on a first end thereof; and forming a mold core by a blown-in method, the mold core including a mold seat having a seating surface, the cylinder bore liner disposed in a seated position in contact with the seating surface of the mold seat, wherein the chamfer of the cylinder bore liner becomes unseated from the seating surface upon thermal expansion of the cylinder bore liner.

In another embodiment, the method of producing a mold package for casting an engine block comprises the steps of providing at least one cast-in-place cylinder bore liner having a longitudinal axis, the bore liner having a seating surface formed on a first end thereof, wherein at least a portion of the seating surface is disposed at an angle with respect to a plane perpendicular to the longitudinal axis; and providing a plurality of mold cores adapted to be assembled to form the mold package, at least one of the mold cores formed by a blown-in method, the mold core formed by the blown-in method including a mold seat having a seating surface, the seating surface of the at least one cylinder bore liner seated on the seating surface of the mold seat in a first position, wherein upon heating of the cylinder bore liner the seating surface of the at least one cylinder bore liner becomes unseated from the first position on the seating surface of the mold seat.

In another embodiment, the method of producing a mold package for casting an engine block comprises the steps of providing at least one cast-in-place cylinder bore liner having a longitudinal axis, the cylinder bore liner having a chamfer formed on a first end thereof, wherein the chamfer of the at least one cylinder bore liner has a substantially frustoconical shape; and providing a plurality of mold cores adapted to be assembled to form the mold package, at least one of the mold cores formed by a blown-in method, the at least one of the mold cores including a mold seat having a seating surface, the chamfer of the at least one cylinder bore liner seated on the seating surface of the mold seat in a first position, wherein upon heating of the cylinder bore liner the chamfer of the at least one cylinder bore liner becomes unseated from the first position on the seating surface of the mold seat.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed and illustrated, the steps presented are exemplary in nature, and thus, the order of the steps is not necessary or critical.

Figure 1:
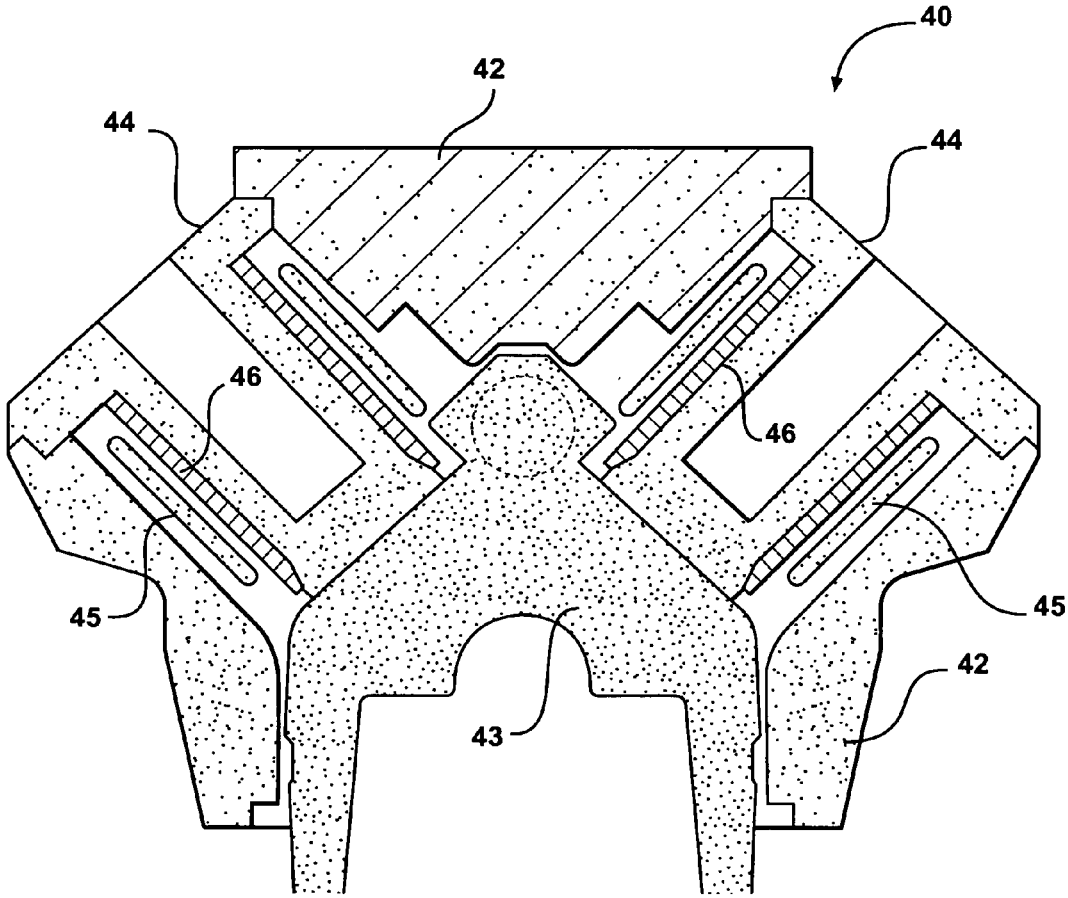
FIG. 1 is a sectional view of a partial mold package.
Figure 2:
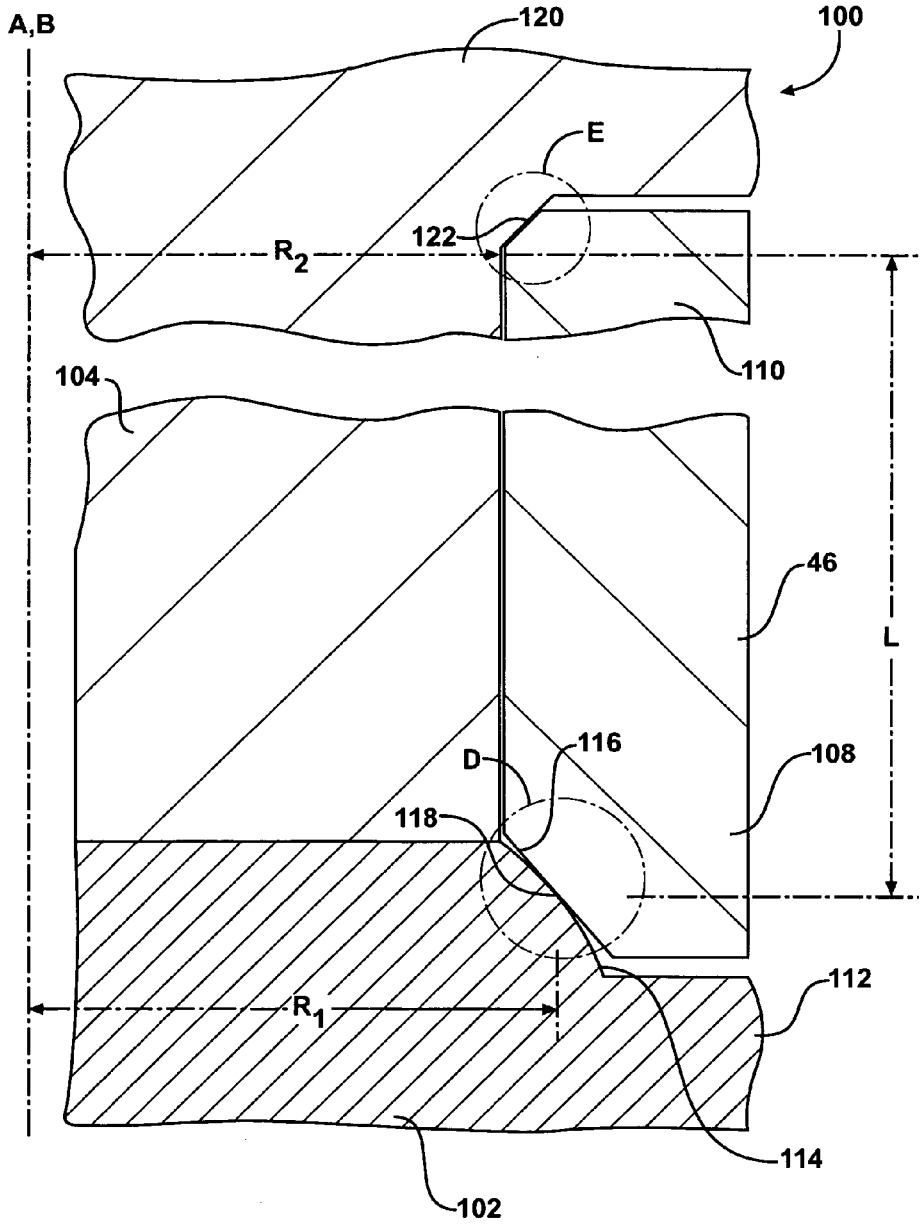
FIG. 2 is a partial sectional view of an embodiment of a casting mold according to the present invention.

FIG. 2 illustrates a partial sectional view of a casting mold 100 for an engine block (not shown) according to an embodiment of the invention for an assembled liner. It will be understood that the engine block includes one or more cylinder bores such as eight bores for a V-8 engine, for example. However, for simplicity, the various embodiments of the invention are described in connection with a single cylinder bore without so limiting the invention. The casting mold 100 includes several mold parts, such as a slab core 102 and a barrel core 104. The mold parts are resin-bonded sand cores and can be made using conventional processes, such as a furan hot box or a phenolic urethane cold box core making processes. Cores can be made using a variety of sands, such as silica, zircon, fused silica, etc. It will also be appreciated that the slab core feature 102 and the barrel core feature 104 may be each made as one integral piece such as the barrel slab core 44 as shown in FIG. 1, for example, or alternatively as a combination of separate interconnected mold parts.

An assembled cylinder bore liner 46 is securely confined between seating surfaces 112, 120 of the slab core 102 and the barrel core 104, respectively. The cylinder bore liner 46 has a longitudinal axis "B" which coincides with a longitudinal axis A of the barrel core 104 when the cylinder bore liner 46 is aligned in the casting mold 100 and there is no lateral displacement or tilting of the cylinder bore liner 46 with respect to the axis A. This position of the cylinder bore liner 46 is defined as the "seated" position. As used herein, seated means to fit correctly on a seat or seating surface in a desired position. Unseated means to move or be removed from a seat or seating surface from the desired position, or no longer be constrained at the desired position. Partial unseating is also included under the meaning of unseated.

The cylinder bore liner 46 has a first end 108 adjacent to the slab core 102 and a second end 110 adjacent to the barrel core 104. In the embodiment shown in FIG. 2, the first end 108 of the cylinder bore liner 46 is in contact with a first mold seat 112, which may be defined by a portion of the slab core 102. The first mold seat 112 has a convex double-curved surface 114, which is symmetric about the axis A and has two radii of curvature at each point. Such a surface is generated by revolving a curved line about the axis A, which is the axis of revolution or symmetry. Conical or cylindrical surfaces, which may be obtained when one radius goes to infinity, are single-curved surfaces. The double-curved surface 114 of the first mold seat may be, for example, a portion of a sphere or torus.

Figure 7:
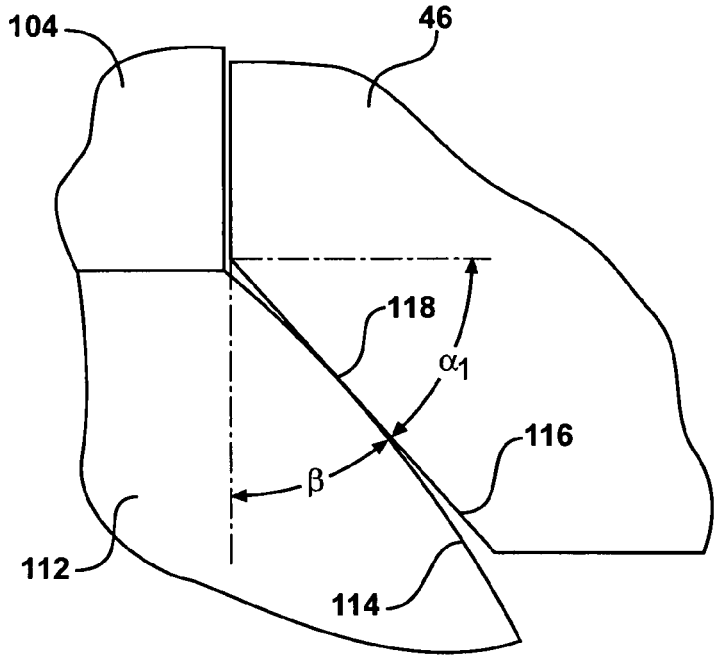
FIG. 7 is an enlarged view of Detail D of FIG. 2.

The cylinder bore liner 46 contacts the surface 114 of first mold seat 112 along a contact circle 118. The contact circle 118 lies on a plane perpendicular to the axis A and has radius $R_1$. In one embodiment, the first end 108 of the cylinder bore liner 46 includes a first end surface 116, which, in this embodiment, is a substantially frustoconical shaped chamfer, as best seen in the detail of FIG. 7. The chamfer 116 is tangent to the first mold seat surface 114 along the contact circle 118 and defines an angle $\alpha_1$ with the plane of the contact circle 118, which is perpendicular to the axis A.

Figure 6:
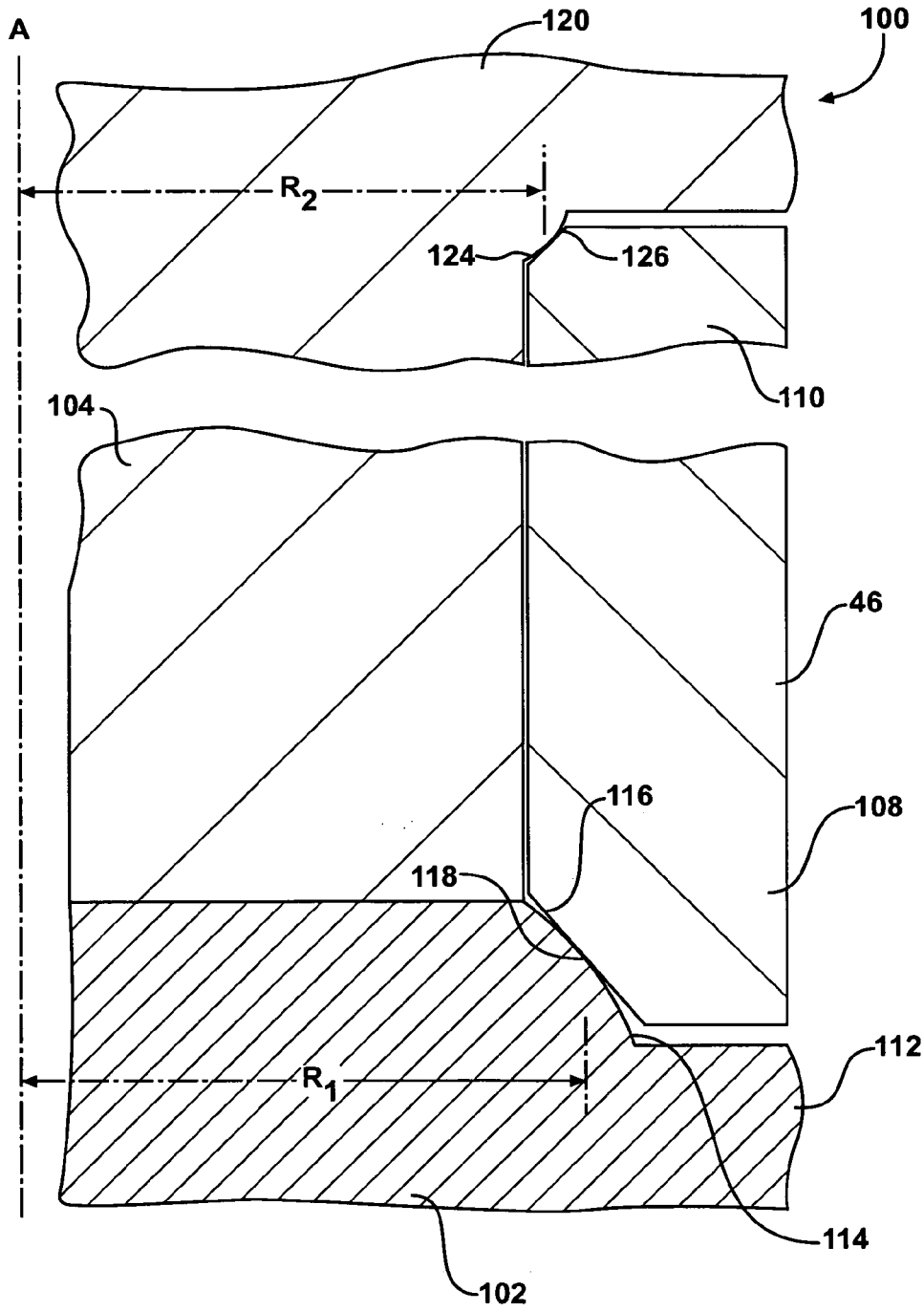
FIG. 6 is a partial sectional view of another embodiment of a casting mold according to the present invention.
Figure 8:
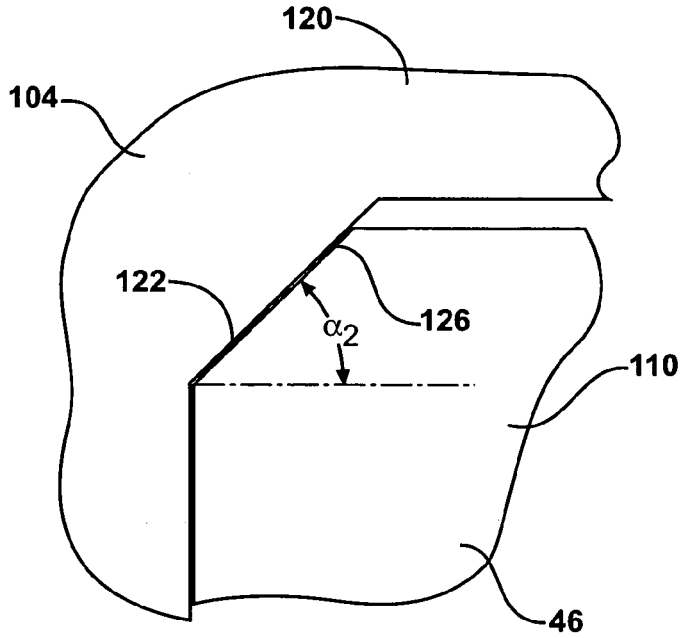
FIG. 8 is an enlarged view of Detail E of FIG. 2.

The second end 110 of the cylinder bore liner 46 is in contact with a second mold seat 120. The second mold seat 120 may contact the second end 110 at a conical surface 122, as shown in FIG. 2, or at a double-curved surface 124, which is similar to the double-curved surface 114 of the first mold seat 112, as shown in FIG. 6. In the embodiment of FIG. 2, the conical surface 122 is inclined at an angle $\alpha_2$ with a plane perpendicular to the axis A, as best illustrated in the detail of FIG. 8. The cylinder bore liner 46 may also include a second end surface 126, which, in this embodiment, is a conical chamfer having the same inclination $\alpha_2$. In the embodiment of FIG. 6, the second chamfer 126 contacts the double-curved surface 124 of the second mold seat 120 tangentially at an angle $\alpha_2$, which is defined by the second chamfer 126 and a plane perpendicular to the axis A. When the double-curved surfaces 114 and 124 of the first and second mold seats 112 and 120 are mirror images of each other, $\alpha_2=\alpha_1=\alpha$.

If all mold components are properly formed and assembled, in its initial state, before any heating resulting from the preheating process (if employed) or from the casting process, the cylinder bore liner 46 is seated on the first and second mold seats 112 and 120; that is the axis A of the bore coincides with the axis B of the cylinder bore liner 46, such that the cylinder bore liner 46 is not laterally displaced with respect to the axis of the bore A. The cylinder bore liner 46 is constrained by the first and second mold seats 112, 120. The angles $\alpha_1$ and $\alpha_2$ are selected such that the cylinder bore liner 46 will become slightly unseated, or no longer securely confined by the first and second mold seats 112, 120, upon heating. Thus, the axis B of the cylinder bore liner 46 may become laterally displaced relative to the axis A by some amount, $G_L$, as shown in an exaggerated manner in FIG. 10. An unseated cylinder bore liner 46 may be moved out of position by gravity, local adhesion of the cylinder bore liner 46 to one or both of the seats 112, 120, or unbalanced metal pressure.

Figure 3:
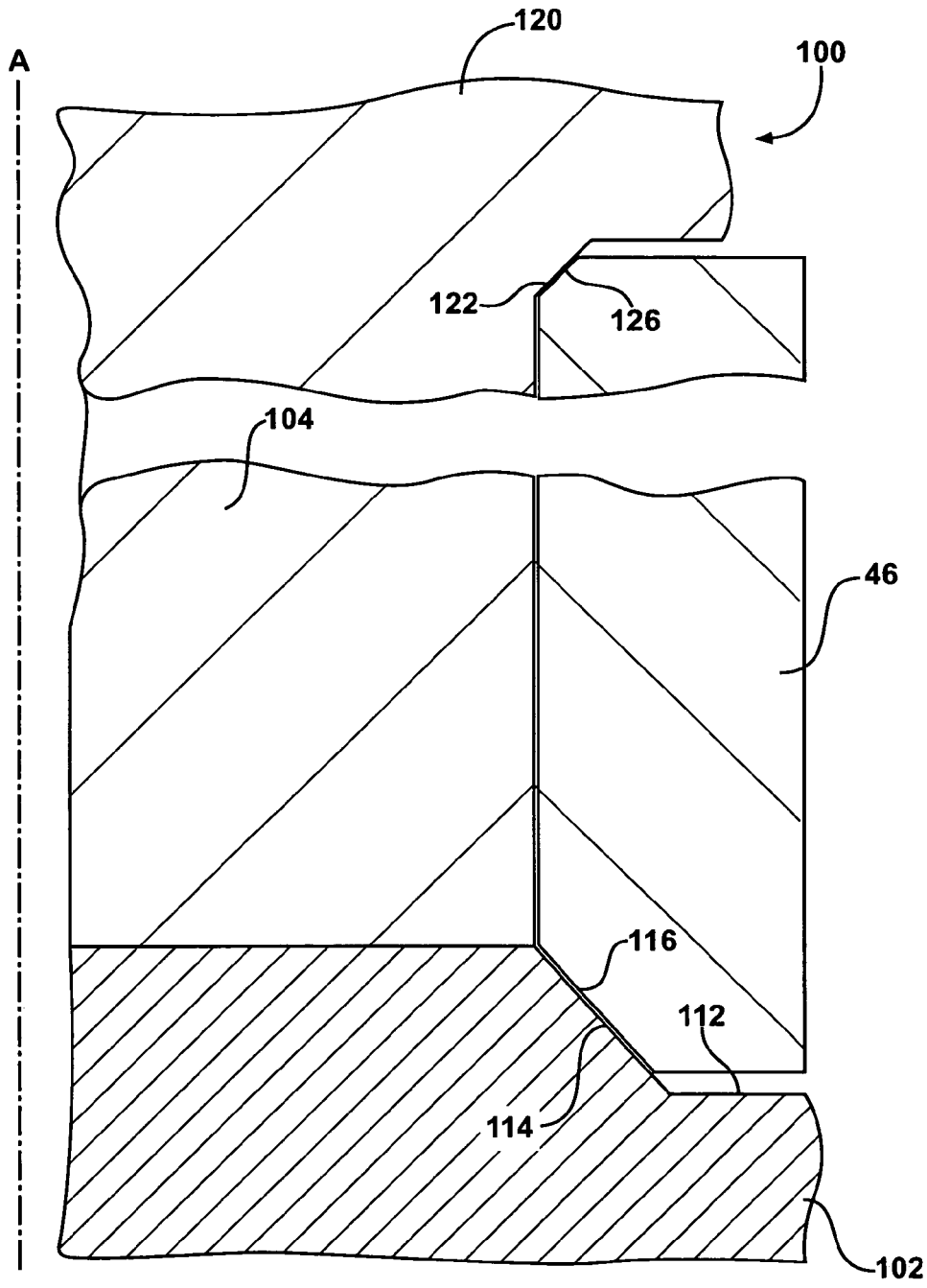
FIG. 3 is a partial sectional view of another embodiment of a casting mold according to the present invention.
Figure 4:
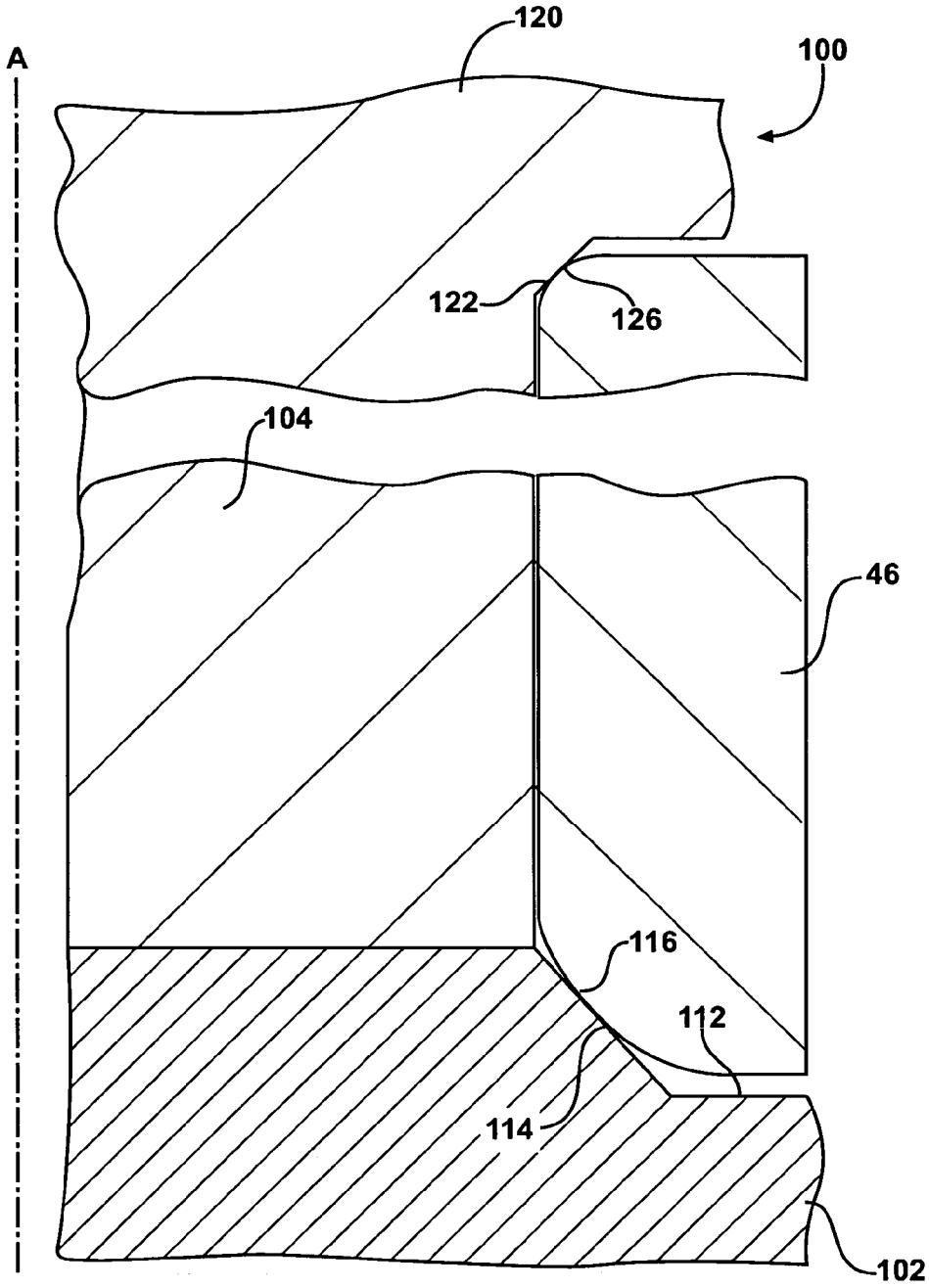
FIG. 4 is a partial sectional view of another embodiment of a casting mold according to the present invention.

In other embodiments, shown in FIGS. 3 and 4, the first mold seat 112 of FIG. 2 may be also configured to have a conically shaped surface which is a mirror image of the conically shaped surface 122 inclined at an angle $\alpha_1=\alpha_2$ with a plane perpendicular to the axis A. Upon thermal expansion, the cylinder bore liner 46 may become unseated from the seated position on the first and second mold seats 112, 120. The cylinder bore liner 46 has first and second end surfaces 116, 126 mating with the conical surfaces 114, 122 of the mold seats 112, 120. In the embodiment of FIG. 3, the end surfaces 116, 126 are conical chamfers. In the embodiment of FIG. 4, the end surfaces 116, 126 of the cylinder bore liner 46 are double-curved surfaces.

Figure 5:
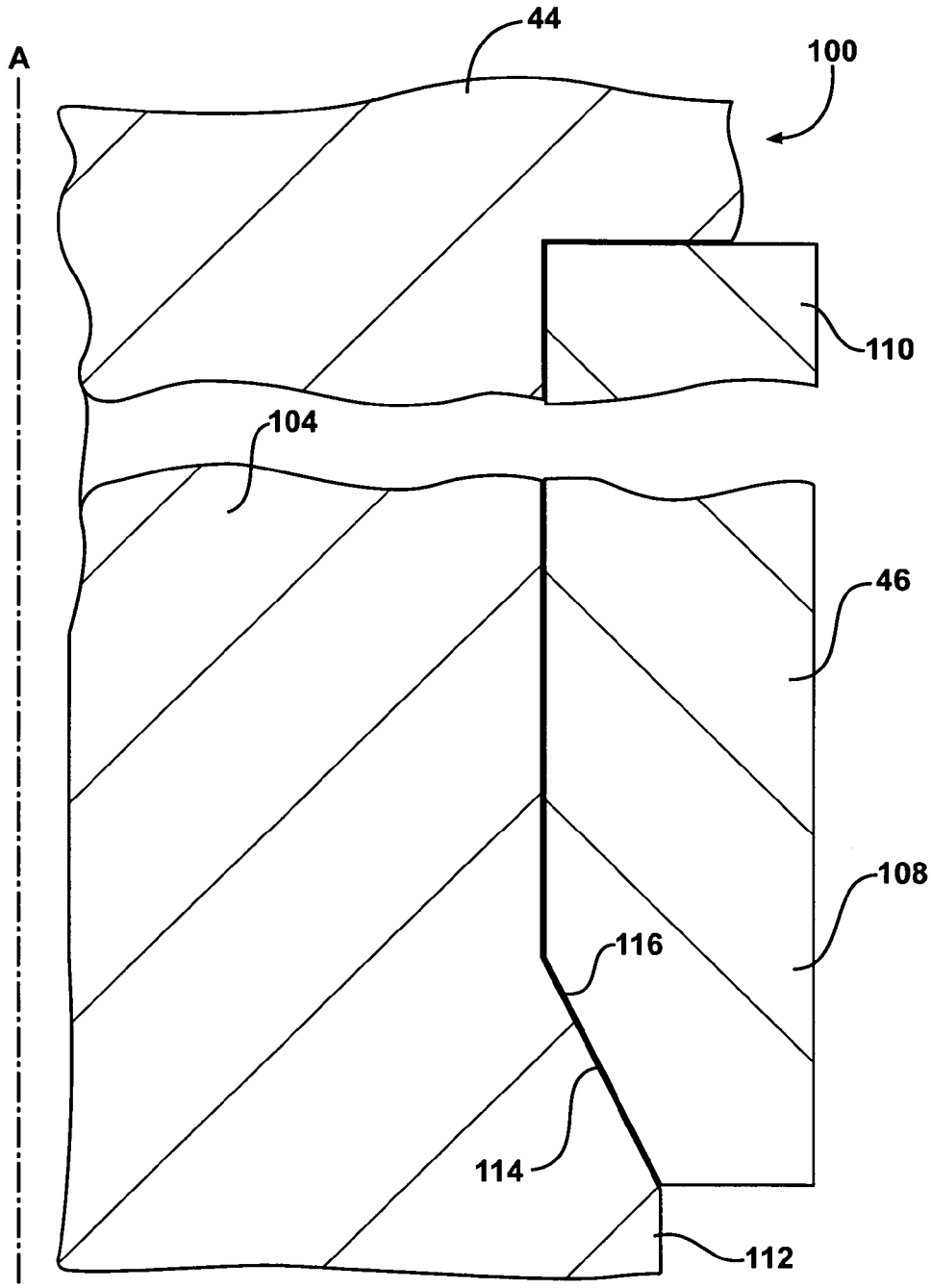
FIG. 5 is a partial sectional view of another embodiment of a casting mold according to the present invention produced by the blown-in method.

In another embodiment shown in FIG. 5, a single mold seat 112 is formed with a substantially frustoconical shaped seating surface 114. The mold seat 112 is formed adjacent a chamfer or seating surface of the cylinder bore liner 46 by blowing core sand into the cylinder bore liner 46 during production of the barrel core 104, which will be further described herein below. With the single mold seat 112, guidance of the cylinder bore liner 46 occurs at the first end 108 thereof.

A method of producing a casting mold for an engine block according to the embodiment of the invention shown in FIG. 5 will now be described. For illustration, forming of a barrel slab core will be described, although it is understood that another core type such as an integral barrel crankcase core can be formed without departing from the scope and spirit of the invention.

Figure 11:
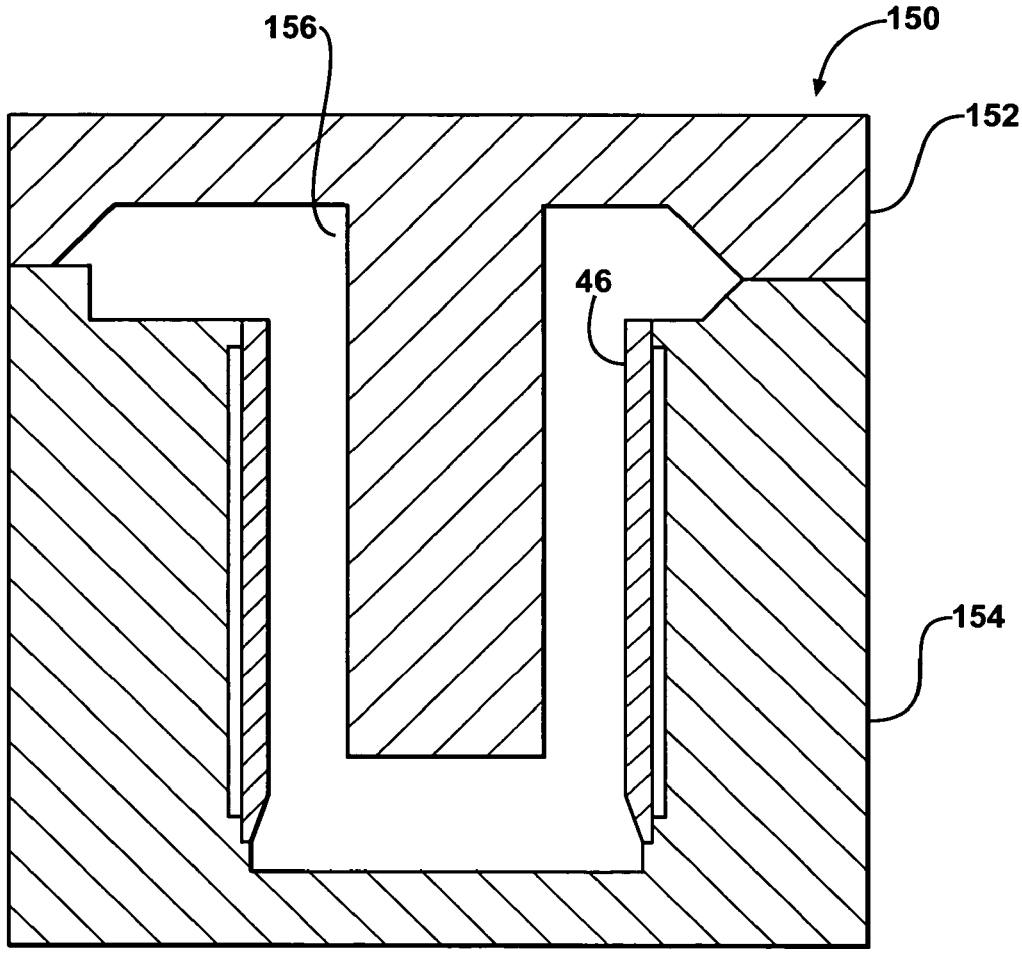
FIG. 11 is a sectional view of a typical barrel slab core box.

To prepare the barrel slab core 44 of FIG 1, the cylinder bore liners 46 are disposed in a core box 150 illustrated in FIG. 11. The core box 150 includes a core box cover 152 disposed on a lower core box portion 154. When the core box 150 is assembled as shown, a void 156 is formed. Core sand (not shown) is blown into the void 156 to form the barrel slab core 44. Any conventional core making process, such as a Furan hot box or a phenolic urethane cold box, for example, can be used to form the barrel slab core 44. Any conventional core sand can be used such as silica, zircon, fused silica, and the like, for example. Typically, the sand and bonding resin are mixed together and blown into the core box 150. The resin is then cured to form the barrel slab core 44. When the resin bonded sand has cured, the barrel slab core 44 is formed with the cylinder bore liners 46 disposed thereon, thereby forming a mold core and cylinder liner subassembly, hereinafter the subassembly. The subassembly is then removed from the core box 150. The cured barrel slab core 44 with the cylinder liner disposed thereon (the subassembly) is now ready for assembly with a water jacket core 45 followed by assembly into a mold package such as the mold package 40 shown in FIG. 1.

For all of the embodiments described, a small migration or misalignment of the axis B relative to the axis A during preheating and/or casting processes is insignificant compared to the damage that may be caused if the cylinder bore liner 46 is constrained to be seated during these processes on the first and second mold seats 112, 120. According to the present teachings, unanticipated and/or unaccounted for thermal expansion of the cylinder bore liner 46 that differs from theory will be accommodated without pushing apart the mold seats 112, 120 and/or crushing or fracturing the material forming the mold seats 112, 120 and contaminating the mold. Unanticipated and/or unaccounted thermal expansion generally results from normal process variations in the actual dimensions and angles of the mold seats 112, 120 and the cylinder bore liner 46, as well as non-uniform thermal expansions during preheating and/or mold filling.

The undesirable consequences of unpredictable thermal expansion of the cylinder bore liner 46 are avoided in the present invention by designing the mold seats 112, 120 and the cylinder bore liner 46 such that the cylinder bore liner 46 becomes slightly unseated during thermal expansion. This is accomplished by allowing an amount of unconstrained expansion at one or both ends 108, 110 of the cylinder bore liner 46. In this regard, the chamfer angles $\alpha_1$ and $\alpha_2$ are selected to exceed the nominal values that are theoretically required for constrained seating by an amount that will not cause excessive unseating or misalignment of the cylinder bore liner 46. For example, the nominal angles required for constant seating for the various embodiments are determined by the following equations:

For assembled type liners:

$$R_1 \times \tan \alpha_1 + R_2 \times \tan \alpha_2 = L$$

Where L is the length of the cylinder bore liner 46 determined at its contact with the mold seats 112, 120, and $R_1$ and $R_2$ are the corresponding radii at the contact with the mold seats. If $R_1=R_2=R$ and $\alpha_1=\alpha_2=\alpha$, then:

$$\tan \alpha = L/2R$$

For blown in type liners:

$$R_1 \times \tan \alpha_1 = L$$

Then:

$$\tan \alpha = L/R_1$$

As an example, consider an assembled type cast iron cylinder bore liner 46 with $R_1=R_2=47.5$ mm and L=140 mm. For this cylinder bore liner 46, the nominal angle $\alpha$ for constrained seating is equal to 55.84°, and the coefficient of thermal expansion (k) is equal to $5.9\times10^{-6}$/° F. For a change in temperature of 1000° F., if $\alpha_1$ and $\alpha_2$ are chosen to be 10° higher than the nominal angle value, or 65.84°, the amount of axial unseating $G_a$ may be calculated as follows. The change in length is $\Delta L$:

$$\Delta L = 1000 \times 5.9 \times 10^{-6} \times 140 = 0.826 \text{ mm}$$

The change in radius R is $\Delta R$:

$$\Delta R = 1000 \times 5.9 \times 10^{-6} \times 47.5 = 0.280 \text{ mm}$$

Figure 9:
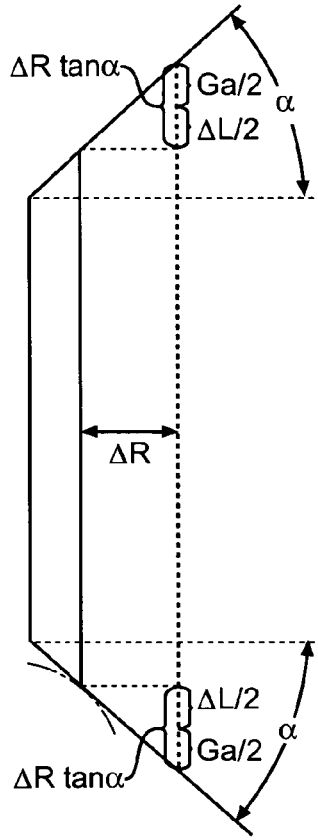
FIG. 9 is a simplified diagram illustrating an amount of axial unseating upon thermal expansion of a cylinder liner according to the present invention.

Referring to FIG. 9, the axial unseating $G_a$ is measured from the tangents to the mold seats at the initial contact points:

$$G_a = 2\Delta R \tan(65.84°) - \Delta L = 0.424 \text{ mm.}$$

Similarly, if only the first angle $\alpha_1$ is increased by 10° to 65.84°, while the second angle $\alpha_2$ is kept at the nominal value of 55.84°, the axial unseating $G_a$ is:

$$G_a = \Delta R \tan(65.84°) + \Delta R \tan(55.84°) - \Delta L = 0.212 \text{ mm.}$$

Therefore, for the cylinder bore liner 46 of this example, an increase of one of the chamfer angles by 10° causes the cylinder bore liner 46 to become axially unseated only by 0.212 mm. An increase of both chamfer angles $\alpha_1$ and $\alpha_2$ by 10° causes the cylinder bore liner 46 to become axially unseated only by 0.424 mm.

Figure 10:
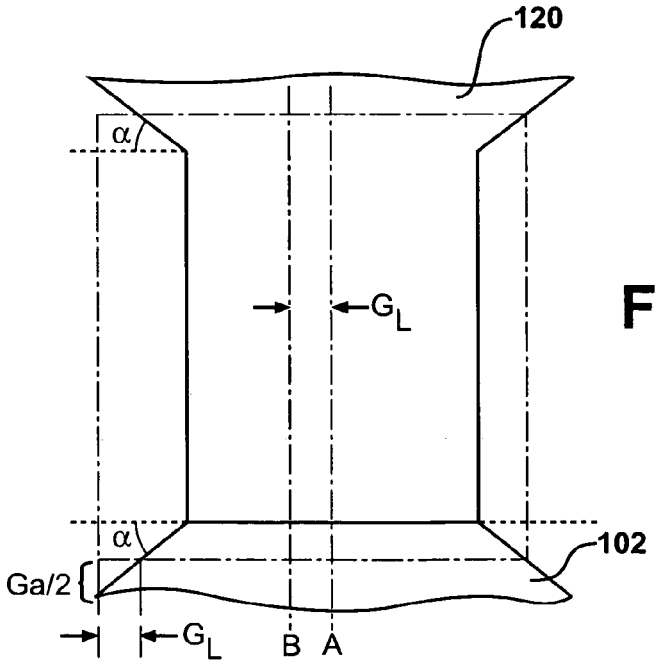
FIG. 10 is a cross-sectional view of the casting mold of the invention illustrating an amount of lateral unseating.

The cylinder bore liner 46 is free to migrate laterally away from the desired bore centerline as a result of $G_a$. FIG. 10 shows that the lateral displacement $G_L$ is equal to $(G_a/2)/\tan \alpha$. In the present example, if both angles are increased by 10°, this results in 0.095 mm of lateral migration.

It will be appreciated from these calculations that by increasing one or both chamfer angles $\alpha_1$ and $\alpha_2$ by as much as 10° from the nominal values that keep the cylinder bore liner 46 seated upon thermal expansion, only small radial or axial unseating of the cylinder bore liner 46 will occur, while many other advantages are realized in addition to preventing mold seat crushing or fracture. For example, the double-curved surface 114 reduces or eliminates scuffing of the mold seat 112 against the corner of the chamfer 116 of the cylinder bore liner 46. The increased chamfer angles $\alpha_1$ or $\alpha_2$ facilitate the insertion of mold seat 102 into the cylinder bore liner 46 during assembly of the mold 100, such that the cylinder bore liner 46 can be correctly assembled, especially in the case of V-type engines where the cylinder bore liners 46 are typically not vertical at the time the mold is assembled. This is illustrated in FIG. 1.

Greater chamfer angles $\alpha_1$ and $\alpha_2$ result in a smaller amount of lateral displacement $G_L$ for a given amount of axial unseating $G_a$. Smaller lateral displacement $G_L$ helps provide better control of any cylinder bore liners 46 which are initially unseated following mold assembly because of dimensional imperfections in the slab core 102, barrel core 104 and cylinder bore liners 46 when the casting mold 100 is assembled.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A method of producing a casting mold for casting an engine block, the method comprising the steps of:

providing a cast-in-place cylinder bore liner having a longitudinal axis, the cylinder bore liner having a chamfer formed on a first end thereof;

providing a core box; and forming a mold core and cylinder bore liner subassembly in said core box by combining the cylinder bore liner with a mold core using a blown-in method, the mold core including a mold seat having a seat surface, the cylinder bore liner disposed in a seated position in contact with the seating surface of the mold seat, wherein the chamfer of the cylinder bore liner becomes unseated from the seating surface upon thermal expansion of the cylinder bore liner.

2. The method according to claim 1, wherein the chamfer of the cylinder bore liner has a substantially frustoconical shape.

3. The method according to claim 2, wherein the seating surface of the mold seat has a substantially frustoconical shape.

4. The method according to claim 1, wherein the mold core is a barrel slab core.

5. The method according to claim 1, wherein an angle of the chamfer of the cylinder bore liner with respect to a plane perpendicular to the longitudinal axis of the cylinder bore liner exceeds a nominal angle theoretically required for constrained seating of the chamfer on the seating surface during heating of the cylinder bore liner.

6. A method of producing a mold package for casting an engine block, the method comprising the steps of:

providing at least one cast-in-place cylinder bore liner having a longitudinal axis, the at least one cylinder bore liner having a seating surface formed on a first end thereof, wherein at least a portion of the seating surface is disposed at an angle with respect to a plane perpendicular to the longitudinal axis;

providing a core box; and providing a plurality of mold cores adapted to be assembled to form the mold package, at least one of the mold cores forming a mold core and cylinder bore liner subassembly in said core box by combining the cylinder bore liner with a mold core using a blown-in method, the mold core formed by the blown-in method including a mold seat having a seating surface, the seating surface of the at least one cylinder bore liner seated on the seating surface of the mold seat in a first position, wherein upon heating of the at least one cylinder bore liner the seating surface of the at least one cylinder bore liner becomes unseated from the first position on the seating surface of the mold seat.

7. The method according to claim 6, wherein the seating surface of the at least one cylinder bore liner is a chamfer.

8. The method according to claim 7, wherein the chamfer of the at least one cylinder bore liner has a substantially frustoconical shape.

9. The method according to claim 8, wherein the seating surface of the mold seat has a substantially frustoconical shape.

10. The method according to claim 7, wherein an angle of the chamfer of the at least one cylinder bore liner with respect to a plane perpendicular to the longitudinal axis of the at least one cylinder bore liner exceeds a nominal angle theoretically required for constrained seating of the chamfer on the seating surface of the mold seat during heating of the at least one cylinder bore liner.

11. The method according to claim 6, wherein the mold core formed by the blown-in method is a barrel slab core.

12. A method of producing a mold package for casting an engine block, the method comprising the steps of:

providing at least one cast-in-place cylinder bore liner having a longitudinal axis, the at least one cylinder bore liner having a chamfer formed on a first end thereof, wherein the chamfer of the at least one cylinder bore liner has a substantially frustoconical shape;

providing a core box; and providing a plurality of mold cores adapted to be assembled to form the mold package, at least one of the mold cores forming a mold core and cylinder bore liner subassembly in said core box by combining the cylinder bore liner with a mold core using a blown-in method, the at least one of the mold cores including a mold seat having a seating surface, the chamfer of the at least one cylinder bore liner seated on the seating surface of the mold seat in a first position, wherein upon heating of the cylinder bore liner the chamfer of the at least one cylinder bore liner becomes unseated from the first position on the seating surface of the mold seat.

13. The method according to claim 12, wherein an angle of the chamfer of the at least one cylinder bore liner with respect to a plane perpendicular to the longitudinal axis of the at least one cylinder bore liner exceeds a nominal angle theoretically required for constrained seating of the chamfer on the seating surface of the mold seat during heating of the at least one cylinder bore liner.

14. The method according to claim 12, wherein the at least one mold core is a barrel slab core.

15. The method according to claim 12, wherein the seating surface of the mold seat has a substantially frustoconical shape.

* * * * *